United States Patent [19]

Freed

[11] Patent Number: 4,698,859

[45] Date of Patent: Oct. 13, 1987

[54] FLAPPER FLUSH VALVE ASSEMBLY

[75] Inventor: Marvin Freed, Thornhill, Canada

[73] Assignee: Brass-Craft Manufacturing Company, Southfield, Mich.

[21] Appl. No.: 852,306

[22] Filed: Apr. 15, 1986

[51] Int. Cl.[4] ..... E03D 1/35

[52] U.S. Cl. ..... 4/393; 4/382; 4/392

[58] Field of Search ..... 4/393, 392, 402, 400, 4/345, 403, 405, 382

[56] References Cited

U.S. PATENT DOCUMENTS

| | | | |
|---|---|---|---|
| 2,142,393 | 1/1939 | Halteman | 4/393 |
| 2,598,967 | 6/1952 | Bennett | 4/417 |
| 2,741,775 | 4/1956 | Schmidt | 4/393 |
| 2,754,522 | 7/1956 | Earsley | 4/393 |
| 2,756,437 | 7/1956 | Svabek, Jr. et al. | 4/392 |
| 2,763,872 | 9/1956 | Nelson | 4/393 |
| 2,774,972 | 12/1956 | Nelson et al. | 4/392 |
| 2,781,520 | 2/1957 | Micek | 4/393 |
| 2,787,004 | 4/1957 | Zinkil et al. | 4/325x |
| 2,787,005 | 4/1957 | Zinkil | 4/353x |
| 2,810,915 | 10/1957 | Zinkil | 4/393 |
| 2,821,721 | 2/1958 | Nelson | 4/392 |
| 2,822,552 | 2/1958 | Zinkil et al. | 4/392 |
| 2,830,302 | 4/1958 | Nelson et al. | 4/392 |
| 2,992,806 | 7/1961 | Kanter et al. | 4/392 X |
| 3,167,787 | 2/1965 | Connealy | 4/393 |
| 3,675,249 | 7/1972 | Breen | 4/393 |
| 3,707,733 | 1/1973 | Gore et al. | 4/393 |
| 4,467,482 | 8/1984 | Dyer | 4/395 |
| 4,499,616 | 2/1985 | Johnson | 4/393 |

*Primary Examiner*—Henry K. Artis

*Attorney, Agent, or Firm*—Krass & Young

[57] ABSTRACT

A flapper valve assembly including an adapter member and a flapper valve member. The adapter member includes a collar portion, a pair of trunions projecting radially outwardly from diametrically opposed locations on the collar portion, and a mounting portion extending rearwardly from the collar portion and defining an elongated slot. The flapper valve member includes a sealing disc for sealing coaction with the valve seat of the outlet passage of the tank, a float bowl extending integrally and centrally downwardly from the sealing disc for positioning within the outlet passage, and a pair of arms extending rearwardly from the sealing disc and including mounting apertures sized to button over the trunions on the adapter member to mount the valve member for pivotal movement on the adapter member between opened and closed positions relative to the valve seat of the outlet passage. In installations including a separate overflow pipe without integral mounting trunions or ears, the collar portion of the adapter member is slid over the overflow pipe and the flapper valve member is pivoted to the trunions of the adapter member. In installations including a separate overflow pipe having integral ears or trunions, the adapter member is dispensed with and the flapper valve member is pivoted directly to the existing ears on the overflow pipe. In installations having an overflow water passage built into a side wall of the tank, the mounting portion of the adapter member is directly mounted to a post upstanding from the base of the water tank and the flapper valve member is pivoted to the adapter member.

7 Claims, 5 Drawing Figures

FLAPPER FLUSH VALVE ASSEMBLY

FIELD OF THE INVENTION

This invention relates to flapper flush valves for flush toilets.

BACKGROUND OF THE INVENTION

A typical flush toilet installation includes a flush tank with an outlet passage communicating with the bowl of the toilet, a valve seat defined within the flush tank and controlling the entry to the outlet passage, and a flapper valve for seating coaction with the valve seat to control the discharge of water from the flush tank to the bowl through the outlet passage.

Many types of flapper valves have been used over the years to control the outlet passage of the toilet and many mounting constructions have been provided to accommodate the movement of the flapper valve between its opened and closed positions. For example, in installations including a separate overflow tube with integral ears or trunions, the flapper valve is pivotally mounted on the ears or trunions on the overflow tube; in installations including a separate overflow tube which does not have integral ears or trunnions, various clamp and wire arrangements are provided to mount the valve on the overflow pipe; and in installations having an overflow passage built into the tank and therefore not having a separate overflow tube, the valve is mounted on a separate anchoring post upstanding from the bottom wall of the flush tank. A different flapper valve construction is therefore required for each mounting arrangement so that, in order to be in a position to replace all of the common flapper valve constructions, a manufacturer must build three or more different types of flapper valves and a supplier must stock an inventory of three or more types of flapper valves. Whereas various attempts have been made in the past to provide flapper valves that are able to accommodate two or more of the common flapper valve mounting arrangements, these multi-purpose valves have had only modest commercial success since they have either been unduly complicated and expensive in construction and/or have failed to function effectively in one or more of the plurality of mounting applications for which they are intended.

SUMMARY OF THE INVENTION

This invention is directed to the provision of a flapper valve assembly which is simple and inexpensive in construction and yet which functions effectively in all of the common flapper valve mounting environments.

The flapper valve of the invention comprises a two-piece assembly including a flapper valve member for sealing coaction with the outlet passage of the tank and an adapter member for mounting the flapper valve member in the tank. The flapper valve member is formed of a resilient material and includes a sealing disc portion for sealing coaction with the valve seat of the outlet passage, a float bowl portion extending integrally centrally downwardly from the sealing disc for positioning within the outlet passage, and a mounting portion defining spaced mounting apertures. The adapter member is also formed of a resilient material and includes a main body portion defining a collar sized to slip over an overflow tube positioned in the tank in laterally offset relation to the outlet passage, a pair of trunion portions extending integrally outwardly on opposite sides of the main body portion and sized to pass through the apertures in the mounting portions of the flapper valve member to mount the flapper valve member for pivotal movement about the axis defined by the trunion portions, and a mounting aperture defined in the main body portion and sized for mounting coaction with an anchoring member positioned in the flush tank in laterally offset relation to the valve seat. This simple two-piece arrangement allows the invention valve assembly to accommodate the three most commonly encountered mounting arrangements.

Specifically, in installations including trunions integral with a separate overflow tube, the adapter member is dispensed with and the flapper valve member is pivoted directly on the integral trunions of the overflow tube; in installations with a separate overflow tube that is devoid of integral ears or trunions, the adapter member is slipped over the overflow tube and the flapper valve member is pivoted to the trunions on the adapter member; and in installations embodying an overflow passage built into a side wall of the flush tank, the mounting aperture defined in the main body portion of the adapter member is mounted on the anchoring member upstanding from the base of the flush tank.

According to a further feature of the invention, the mounting aperture in the adapter member comprises a slot elongated in the direction of the axis of the trunions and sized for buttoning over an anchoring member of the buttonhead type.

According to a further feature of the invention, the mounting portions of the flapper valve member comprise parallel spaced arms extending from the disc portion of the flapper valve member, and the trunions of the adapter member extend radially outwardly from generally diametrically opposed locations on the collar of the adapter member so that the collar, with the flapper valve member mounted on the trunions, is positioned between the arms. This provides a compact and efficient arrangement as between the adapter member and the flapper valve member.

According to a further feature of the invention, the mounting portion of the adapter member extends outwardly from the collar between the trunions This arrangement preserves the ability of the collar to slip readily over the overflow tube and facilitates the attachment of the mounting portion of the adapter member to an anchoring member in the tank.

DETAILED DESCRIPTION OF THE PREFERRED EMBODIMENT

The invention flapper valve assembly includes a flapper valve member 10 and an adapter member 12, both formed of a suitable resilient material such as a moderately soft rubber.

Flapper valve member 10 includes a disc portion 10*a*, an integral float bowl portion 10*b*, and a pair of integral mounting arm portions 10*c*.

Disc portion 10*a* is generally circular and includes an annular peripheral seating portion 10*d* and a flat rear edge portion 10*e*.

Float bowl portion 10*b* is hollow and generally conical and extends centrally downwardly from disc portion 10*a* to terminate in an opening 10*f*. The hollow interior of bowl portion 10*b* communicates with the hollow of a dome portion 10*g* extending centrally upwardly from disc portion 10*a* so that bowl portion 10*b* and dome portion 10*g* coact to define a float chamber 10*h*. A radial rib 10*i* on dome portion 10*g* defines an aperture 10*j* for attachment of the usual pull chain 13.

Arm portions 10*c* extend rearwardly from disc portion 10*a* in parallel fashion on opposite sides of flat rear edge portion 10*e*. Each arm portion 10*c* includes a bearing block portion 10*k* defining a mounting aperture 10*l*, and a reinforcing rib portion 10*m*.

Adapter member 12 includes a main body portion 12*a* defining a collar 12*b*; a pair of trunion portions 12*c*; and a mounting portion 12*d*.

Collar portion 12*b* is circular and has an outer diameter slightly less than the lateral distance between the confronting faces of arm portions 10*c* of the flapper valve member.

Trunion portions 12*c* extend radially outwardly from collar portion 12*b* from generally diametrically opposed locations on the collar portion. Each trunion portion 12*c* includes a head portion 12*j*, a shank portion 12*e*, and a base portion 12*f*. Head portions 12*j* have a diameter slightly larger than the diameter of mounting apertures 10*l* in bearing block portions 10*k*, and trunion portions 12*e* have a diameter slightly less than the diameter of mounting apertures 10*l*.

Mounting portion 12*d* extends rearwardly from collar 12*b* and has a generally T-configuration with the stem portion 12*g* of the T extending rearwardly from the collar 12*b* between trunions 12*c* and the crossbar portion 12*h* of the T defining an elongated, somewhat diamond-shaped slot 12*i* extending in the direction of the pivotal axis defined by the trunions.

Figure 1:
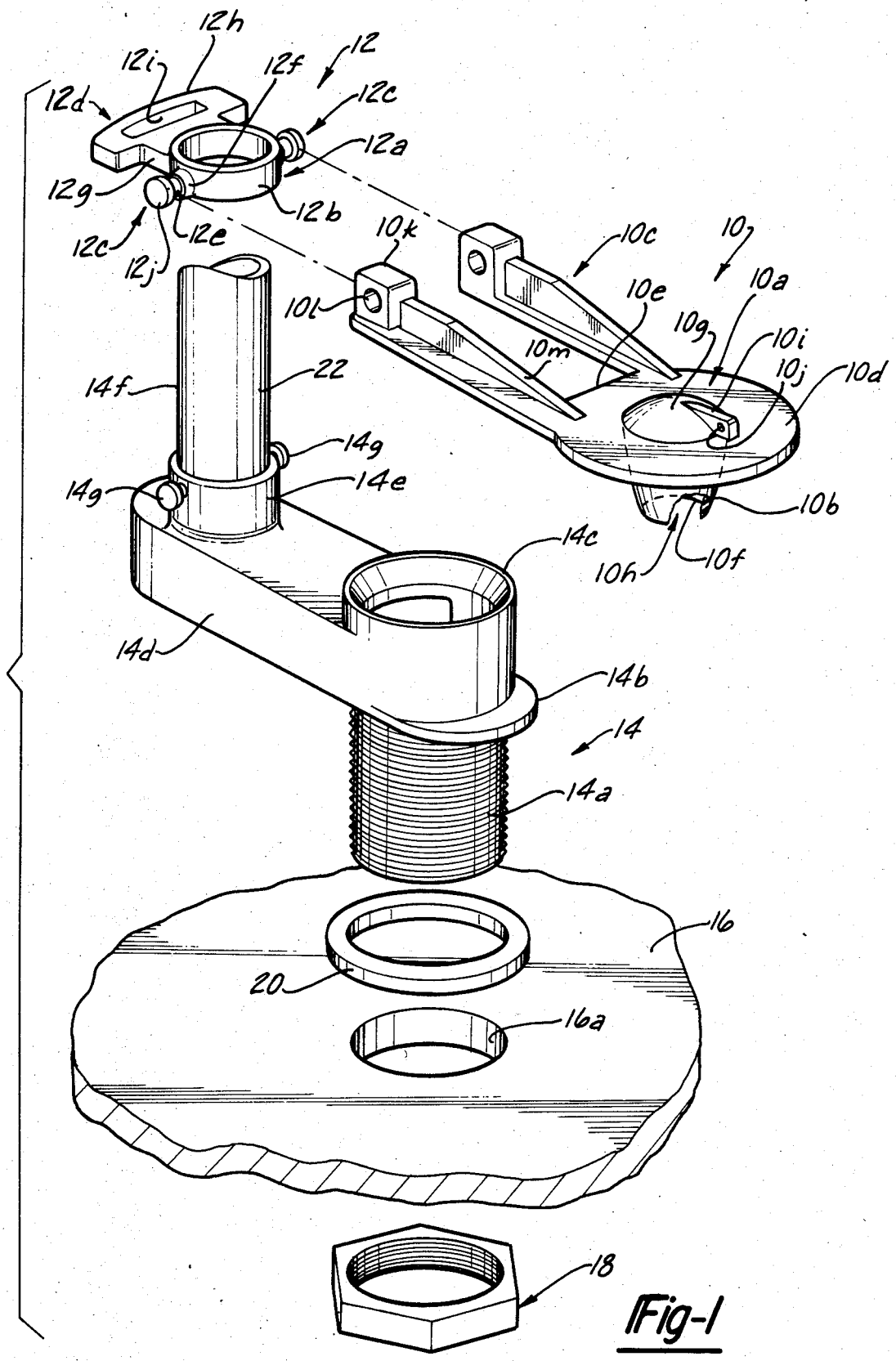
FIG. 1 is an exploded fragmentary perspective view of the invention flapper valve assembly shown in association with a common tank outlet fitting.
Figure 2:
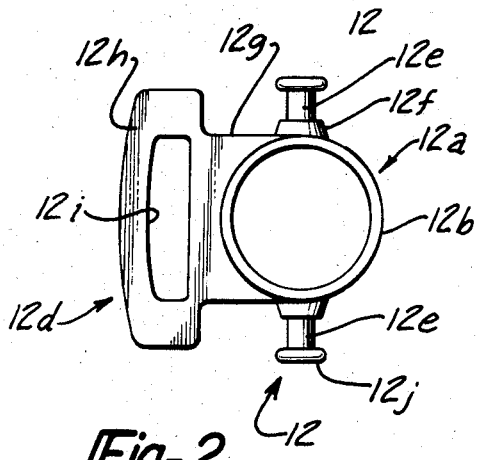
FIG. 2 is a plan view of the adapter member of the invention flapper valve assembly.
Figure 3:
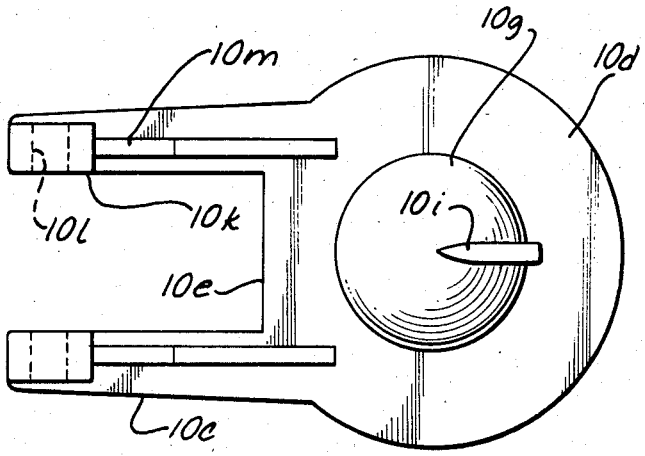
FIG. 3 is a plan view of the flapper valve member of the invention valve assembly.

The invention flapper valve assembly is seen in FIG. 1 in association with a flush toilet assembly of the type including an outlet fitting 14 adapted to be positioned within the flush tank of the toilet installation by passage of threaded portion 14*a* through the standard drain opening 16*a* in the bottom wall 16 of the flush tank for engagement by a suitable nut 18 to secure the outlet fitting 14 to the flush tank with a washer 20 interfitting between the bottom wall of the flush tank and a flange portion 14*b* of the outlet fitting to preclude leakage through drain opening 16*a*. Outlet fitting 14 defines a valve seat 14*c* and includes a hollow lateral extension 14*d* including a boss 14*e* receiving an overflow pipe 14*f*. A pair of integral trunions or ears 14*g* are provided at diametrically spaced locations on boss 14*e*.

In the use of the invention flapper valve assembly with the toilet installation of FIG. 1, the adapter member 12 is dispensed with and the mounting apertures 10*l* of the flapper valve member are passed over the trunions or ears 14*g* to journal the bearing block portion 10*k* of the flapper valve member on the trunions 14*g* and mount the flapper valve member for pivotal movement about the axis of the trunions 14*g* between a closed position in which seating portion 10*d* sealingly engages valve seat 14*c* and an open position, instigated by actuation of chain 13, in which seating portion 10*d* is displaced from valve seat 14*c* and the flapper valve member is maintained in a raised position above the valve seat by the floating action of bowl portion 10*b*.

Figure 4:
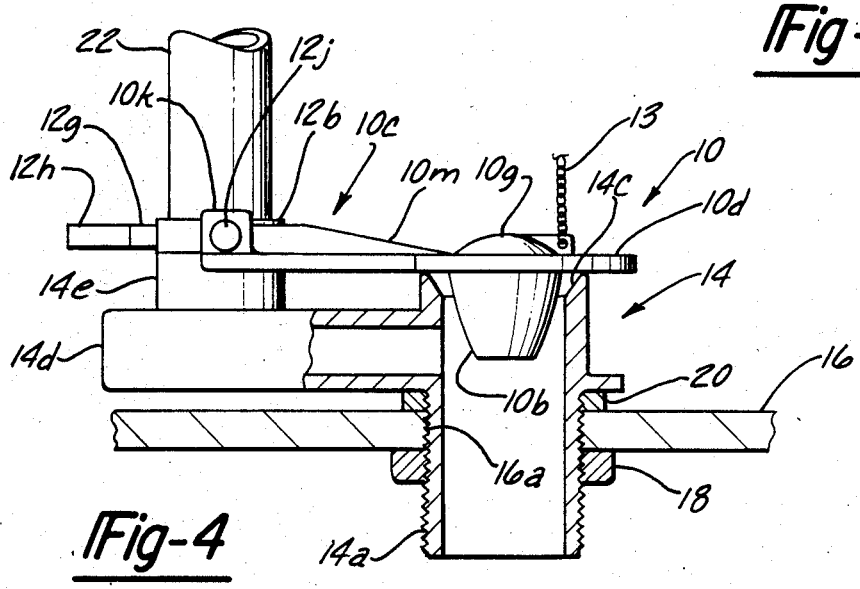
FIG. 4 is a fragmentary cross-sectional view of the invention flapper valve assembly shown in association with a second common type of tank outlet fitting.

The invention flapper valve assembly is shown in FIG. 4 in association with a toilet installation including a valve outlet 14 which does not include integral ears or trunions on the overflow pipe. In installations of this type, the original flapper valve would have been mounted to the overflow pipe by the use of various clamp and wire assemblies. In the use of the invention flapper valve assembly with the toilet installation of FIG. 4, adapter member 12 is slid downwardly over overflow pipe 22 with the lower annular face of collar portion 12*b* seating against the upper annular face of boss portion 14*e*, whereafter mounting apertures 10*l* of the flapper valve member are buttoned over the head portions 12*j* of the trunions and into journalling engagement with shank portions 12*e* to mount the flapper valve for pivotal movement between its open and closed positions relative to valve seat 14*c*.

Figure 5:
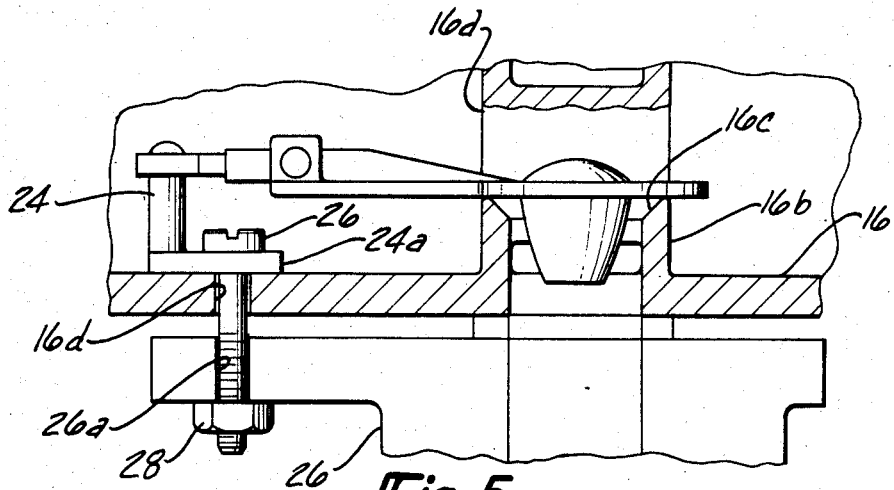
FIG. 5 is a fragmentary cross-sectional view of the invention flapper valve assembly shown in association with a toilet assembly of the type including an integral overflow passage in the toilet tank.

The invention flapper valve is shown in FIG. 5 in association with a toilet installation of the type in which the bottom of the toilet tank is formed integrally with an upstanding boss or collar 16*b* defining an annular valve seat 16*c*; an overflow passage 16*d* is formed integrally with a vertical side wall of the toilet tank; and a mounting post 24 is secured to the bottom wall 16 of the toilet tank in laterally offset relation to valve seat 16*c* by a bolt 26 passing through a flange portion 24*a* of the mounting post, through an opening 16*d* in the bottom wall of the flush tank, and through an opening 26*a* in the bowl 26 of the toilet installation for engagement with a nut 28 so that bolt 26 serves to mount post 24 on the bottom wall of the flush tank as well as secure the flush tank to the toilet bowl. In the use of the invention flapper valve assembly with the toilet installation of FIG. 5, adapter member 12 is mounted to post 24 by securing mounting portion 12*d* to the upper end of the post whereafter the mounting apertures 10*l* of flapper valve member 10 may be buttoned over trunions 12*c* to pivotally mount the flapper valve for opening and closing movement relative to valve seat 16*c*. In installations where the upper end of mounting post 24 is provided with a button head, elongated slot 12*i* of mounting portion 12*d* is buttoned over the upper buttonhead end of the mounting post to secure the adapter member to the post. In other installations, a suitable cap may be provided at the upper end of the post to clamp the mounting portion 12*d* of the adapter member 12 to the upper end of the post.

The invention flapper valve assembly will be seen to provide a construction which is simple and inexpensive and which enables the invention flapper valve assembly to be used to provide a replacement flapper valve for all of the commonly encountered toilet installations currently in use. Further, the invention flapper valve assembly does not require any cutting or other customizing to enable the assembly to be used in any of the installations. Rather, the installer simply determines the character of the existing installation and then directly installs the flapper valve assembly, with or without the adapter member, to provide the desired pivotal mounting for the flapper valve member.

Although a preferred embodiment of the invention has been illustrated and described in detail, it will be apparent that various changes may be made in the disclosed embodiment without departing from the scope or spirit of the invention.

I claim:

1. A two-piece flapper flush valve assembly for use with a flush toilet having a flush tank with an outlet passage communicating with the bowl of the toilet and a valve seat defined within the flush tank and controlling the entry to the outlet passage, said assembly comprising:

(A) a flapper valve member formed of a resilient material and defining
  (1) a sealing disc portion for sealing coaction with the valve seat of the outlet passage,
  (2) a float bowl portion extending integrally centrally downwardly from said sealing disc portion for positioning within the outlet passage, and
  (3) mounting portions defining spaced mounting apertures; and (B) an adapter member formed of a resilient material and defining
  (1) a main body portion defining a collar sized to slip over an overflow tube positioned in the tank in laterally offset relation to the outlet passage,
  (2) a pair of trunion portions extending integrally outwardly on opposite sides of said main body portion and configured to pass through said mounting apertures in said mounting portions of said flapper valve member to removably mount said flapper valve member for pivotal movement about the axis defined by said trunion portions, and
  (3) a mounting portion extending laterally outwardly from said collar between said trunion portions and defining a mounting aperture sized for mounting coaction with an anchoring member positioned in the flush tank in laterally offset relation to the valve seat.

2. A flush valve assembly according to claim 1 wherein:

(C) said mounting aperture comprises a slot elongated in the direction of said axis and sized for buttoning over an anchoring member of the buttonhead type.

3. A flush valve assembly according to claim 1 wherein:

(D) said mounting portions of said flapper valve member comprise parallel spaced arms extending from said disc portion; and (E) said trunion portions extend radially outwardly from generally diametrically opposed locations on said collar so that said collar, with said flapper valve member mounted on said trunion portions, is positioned between said arms.

4. A flush valve assembly according to claim 3 wherein:

(F) said mounting aperture comprises a slot elongated in the direction of said axis.

5. An attachment for use with a flush toilet having a flush tank with an outlet passage communicating with the bowl of the toilet, a valve seat defined within the flush tank and controlling the entry to the outlet passage, and a flapper valve for seating coaction with the valve seat, said attachment being formed of a resilient material and comprising:

(A) a main body portion defining a collar sized to slip over an overflow tube positioned in the tank in laterally offset relation to the outlet passage;

(B) a pair of integral trunion portions extending outwardly from opposite sides of said main body portion and configured to pass through mounting apertures in the flapper valve to removably mount the flapper valve for pivotal movement about the axis defined by said trunion portions;

(C) a mounting portion extending laterally outwardly from said collar between said trunion portions and defining a mounting aperture sized for mounting coaction with an anchoring member positioned in the flush tank in laterally offset relation to the outlet passage.

6. An attachment according to claim 5 wherein:

(D) said trunion portions extend radially outwardly from generally diametrically opposed locations on said collar; and (E) said mounting aperture comprises a slot elongated in the direction of said axis.

7. An attachment according to claim 6 wherein:

(F) said mounting portion is generally T-shaped with the stem portion of the T extending outwardly from the collar and the elongated slot defined within the crossbar portion of the T.

* * * * *